United States Patent [19]

Aoki

[11] Patent Number: 4,741,172

[45] Date of Patent: May 3, 1988

[54] REFRIGERATED DISPLAY CABINET

[75] Inventor: Shigeki Aoki, Maebashi, Japan

[73] Assignee: Sanden Corporation, Isesaki, Japan

[21] Appl. No.: 937,053

[22] Filed: Dec. 2, 1986

[30] Foreign Application Priority Data

Dec. 4, 1985 [JP] Japan ..... 60-185971[U]

[51] Int. Cl.[4] ..... A47F 3/04

[52] U.S. Cl. ..... 62/248; 62/507

[58] Field of Search ..... 62/277, 248, 507

[56] References Cited

U.S. PATENT DOCUMENTS

| | | | |
|---|---|---|---|
| 2,462,705 | 2/1949 | Abeling | 62/277 |
| 2,542,136 | 2/1951 | Hanson et al. | 62/248 X |
| 2,673,455 | 3/1954 | Brinkoeter | 62/277 X |
| 2,696,087 | 12/1954 | Luecke | 62/248 |
| 2,706,387 | 4/1955 | Swanson | 62/248 |
| 2,865,182 | 12/1958 | Schultz | 62/507 X |
| 2,911,799 | 11/1959 | Guyton et al. | 62/248 |
| 3,269,787 | 8/1966 | Harter | 62/248 X |
| 3,462,966 | 8/1969 | Reid et al. | 62/248 |
| 4,009,586 | 3/1977 | Skvarenina | 62/277 X |

*Primary Examiner*—William E. Tapolcai

*Attorney, Agent, or Firm*—Banner, Birch, McKie & Beckett

[57] ABSTRACT

There is disclosed a refrigerated display cabinet provided with a refrigerating chamber and a mechanical chamber in which the rear wall of the refrigerating chamber and a rear plate that closes the open end of the mechanical chamber are in a common plane spaced from the plane defined by the rear edges of the side walls of the cabinet to provide a space between the cabinet and a wall against which the cabinet is set so that air can be exhausted from the mechanical chamber through said space and directed through a duct onto the transparent panels through which goods in the cabinet are displayed to prevent condensation on said transparent panels.

3 Claims, 6 Drawing Sheets

REFRIGERATED DISPLAY CABINET

BACKGROUND OF THE INVENTION

This invention relates to a refrigerated display cabinet, and more particularly, to improving the outer configuration of the cabinet for effectively using the warm air exhausted by the refrigerating unit to prevent condensation at the transparent panels through which the merchandise is displayed.

Refrigerated display cabinets that are used in stores for storing and dislaying refrigerated products comprise a refrigerating chamber for the merchandise and a mechanical chamber that contains the refrigerating apparatus. This mechanical chamber is normally in the lower portion of cabinet and, in the operation of the refrigerating apparatus, heat is generated. To dissipate this heat, the mechanical chamber has a plurality of holes in the rear cover to provide for the circulation of air which is normally exhausted to the rear of the cabinet. Therefore, as shown in FIG. 1, there has heretofore been provided a cover plate 2 projecting from the rear of the cabinet 1 and having a plurality of holes 2*a*. Thus, when the refrigerated display cabinet 1 is placed near a wall, the projection of the cover plate 2 still provides a space for exhausting the warm air from the mechanical chamber.

The usual refrigerated display cabinets have also heretofore been provided with refrigerating chambers having an opening covered by glass panels for controlling the temperature therein while providing for the display of the goods in the cabinet. However, in these refrigerating dislay cabinets, condensation sometimes accumulates on the glass panels which must be removed in order to maintain the visibility of the goods through the glass panels. To remove this condensation, as shown in FIG. 2, warm air exhausted from the mechanical chamber has been forced by a blower 6 from the mechanical chamber through a duct 3 at the rear and top of the cabinet onto the outer surface of the glass panel 5. Devices of this nature have the disadvantage that they are complicated and the duct 3 increases the size of the cabinets.

SUMMARY OF THE INVENTION

It is a primary object of present invention to provide an improved refrigerated display cabinet having a simplified configuration to permit more flexibility in the use of the cabinet.

It is another object of present invention to provide a refrigerated display cabinet having a simplified means for effectively exhausting air from the cabinet.

It is still another object of present invention to provide a refrigerated display cabinet with improved means for removing condensation from the glass panel of the cabinet.

A refrigerated display cabinet according to the present invention includes an upper refrigerating chamber where merchandise is stored and displayed and a lower mechanical chamber in which the refrigerating apparatus is located. The upper or access opening into the refrigerating chamber is covered by transparent panels formed for example of glass. The mechanical chamber has an opening at the rear thereof to provide for the circulation of air from the interior of the mechanical chamber to the atmosphere, and an apertured cover plate disposed over the opening. The refrigerating chamber is defined by a front wall and a rear wall, a bottom wall connected between the lower portion of the front and rear walls, and pair of side walls. The apertured cover plate that closes the rear of the mechanical chamber is aligned in the same plane as the rear wall, and this plane is spaced forwardly from the plane defined by the rear edges of the side walls to provide a space between the rear wall and a wall against which the cabinet is set.

One aspect of present invention is that the opening at the top of the refrigerating chamber is partly covered by an upper wall having a duct to direct air from the rear of the cabinet to the outer surface of the transparent panels.

Further objects, features, and other aspects of present invention will be understood from the following detailed description of the preferred embodiments of this invention referring to the attached drawings.

DETAILED DESCRIPTION

Figure 1:
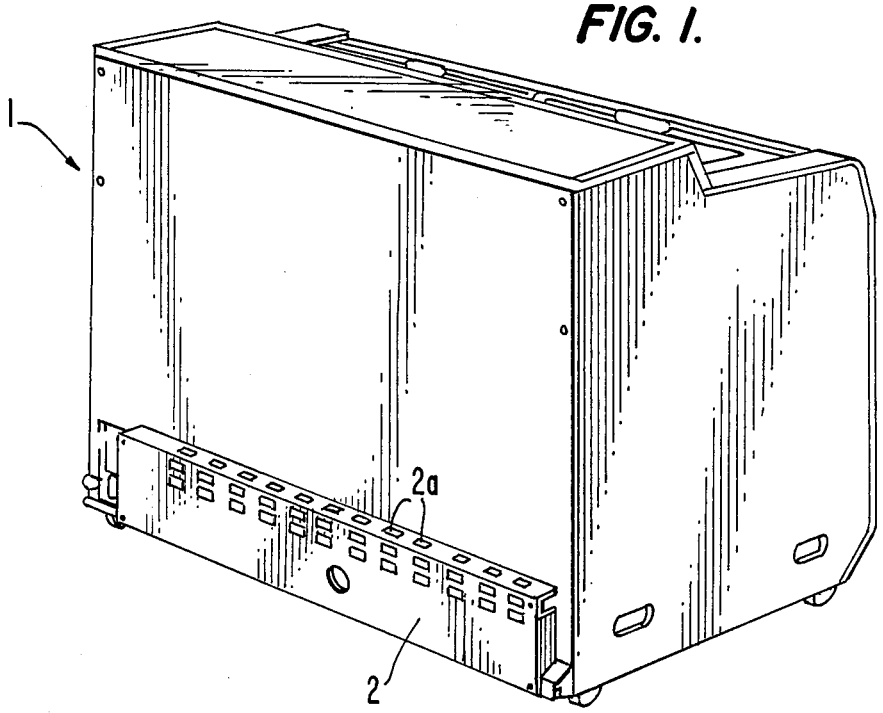
FIG. 1 is a perspective view of conventional refrigerated display cabinet illustrating the rear side of the cabinet.
Figure 2:
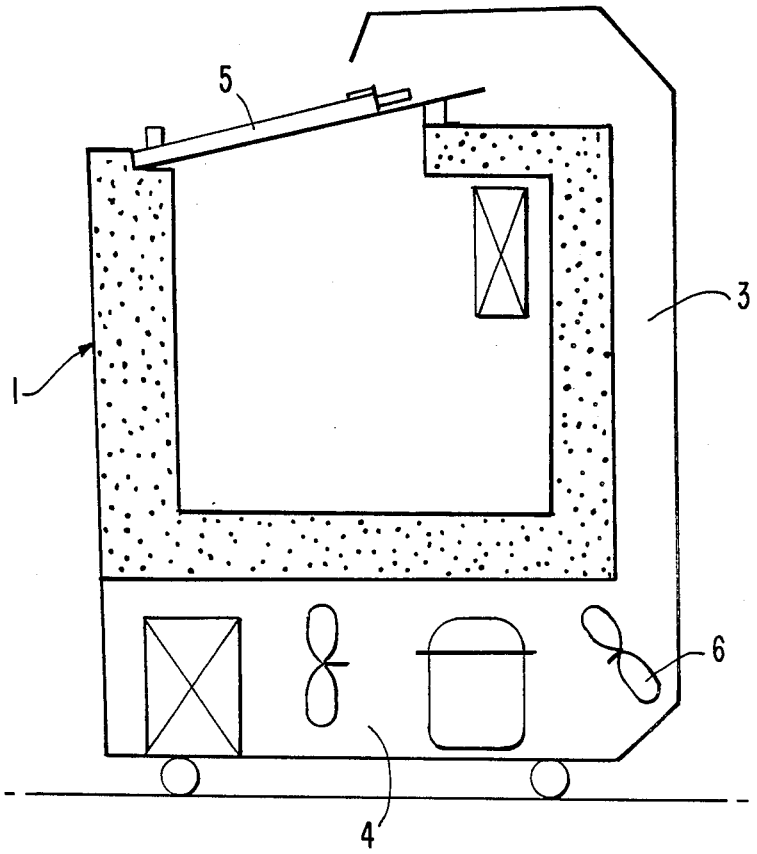
FIG. 2 is a diagrammatical sectional view of another conventional refrigerated display cabinet.
Figure 3:
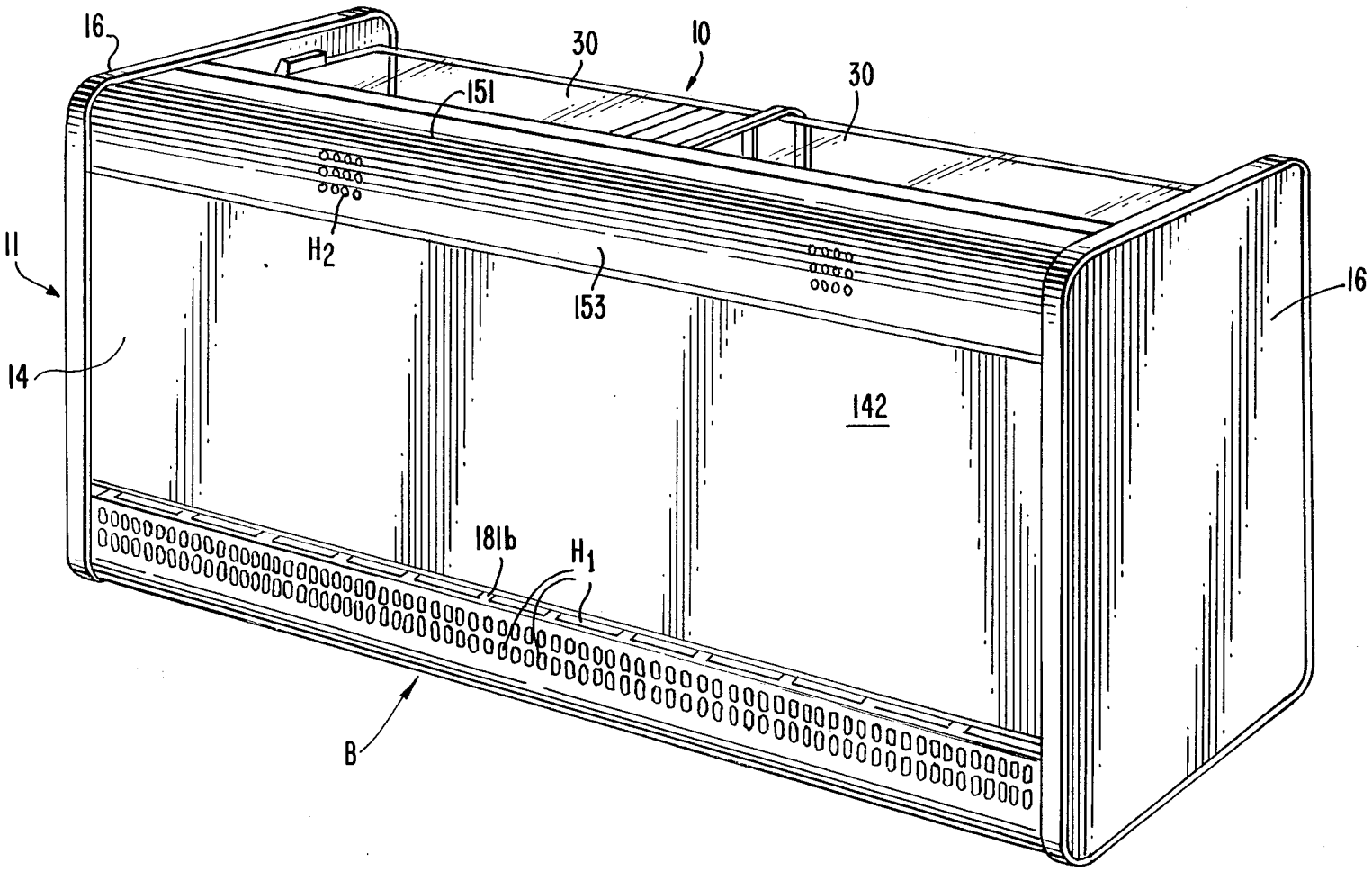
FIG. 3 is a perspective view of a refrigerated display cabinet in accordance with one embodiment of the present invention.
Figure 4:
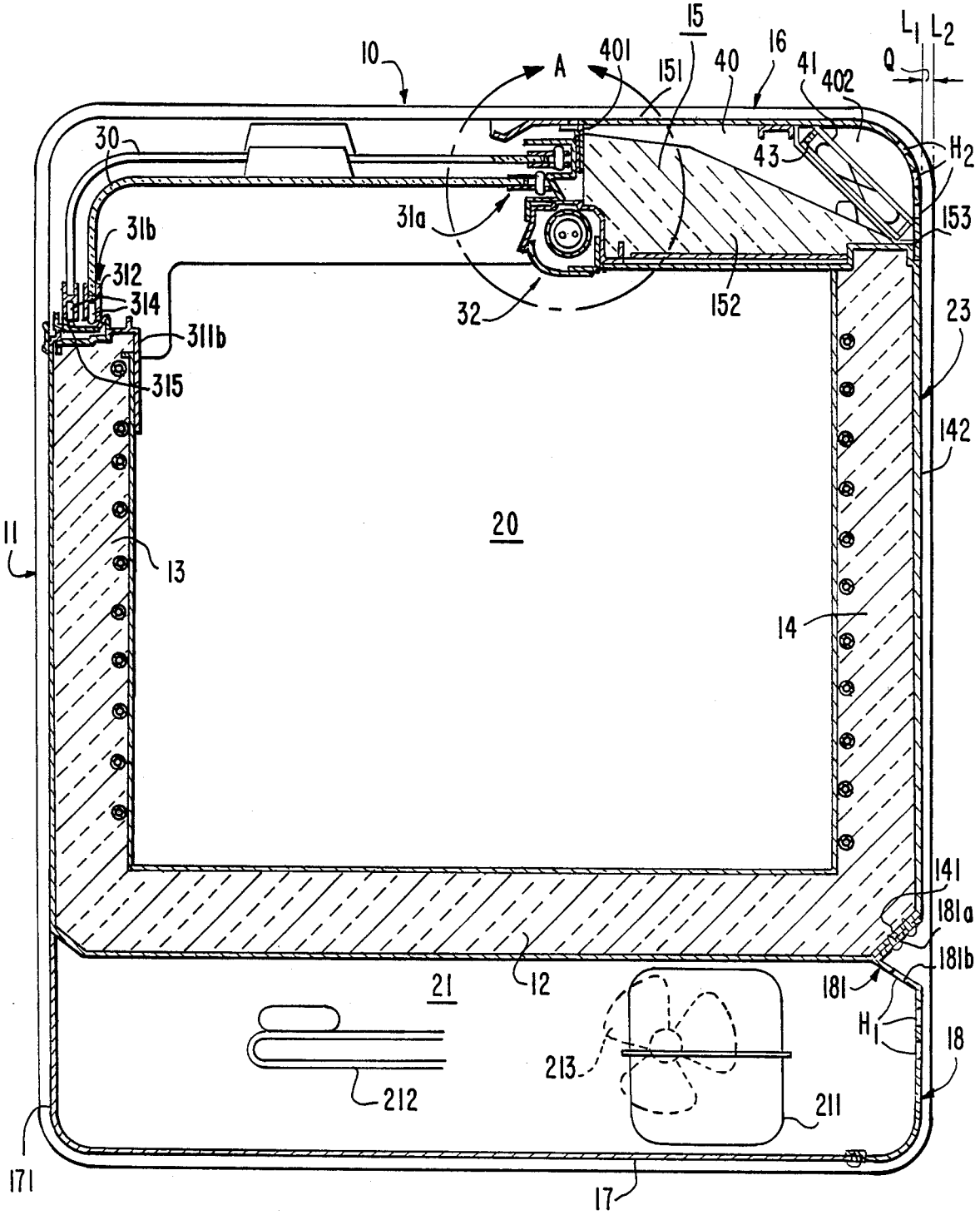
FIG. 4 is a vertical sectional view of the refrigerated display cabinet of FIG. 3.

Referring to FIGS. 3 and 4, a refrigerated display cabinet 10 in accordance with the present invention is shown. The refrigerated display cabinet 10 has a refrigerating chamber 20 and a mechanical chamber 21 in the upper and lower portions thereof respectively. Refrigerating chamber 20 is suitably secured within a cabinet 11 and has a bottom insulated wall 12 disposed above the base of the cabinet 11 and defining the top of the mechanical chamber 21. Refrigerating chamber 20 has an insulated front wall 13 and an insulated rear wall 14 terminating at its upper end in an overhanging upper wall 15 which extends forwardly to partly cover the upper or access opening of the refrigerating chamber 20. The ends of the refrigerating chamber 20 are closed by insulated end walls 16.

The upper or access opening of the refrigerating chamber 20 is covered by two transparent glass panels 30 that are slidably supported at their edges on the upper wall 15 and front wall 13 through guide rail mechanisms 31*a* and 31*b* respectively. The details of these guide rail mechanisms will be explained hereinafter. The interior of the refrigerating chamber 20 is illuminated by an illuminating means 32 to display the merchandise therein more effectively.

Mounted on the bottom plate 17 of the cabinet 11 in the mechanical chamber 21 are various elements of the refrigerating apparatus other than the evaporator, such as a compressor 211 and condenser 212. In the usual manner, gaseous refrigerant is compressed by compressor 211 and is then passed through the condensor 212 where it is cooled and condensed to a liquid. Air is drawn over the condenser 212 by a blower 213 to remove heat.

A front plate 171 is integral with and extends upwardly from the front end portion of the bottom plate 17 to cover the front of the mechanical chamber 21. The rear of the mechanical chamber 21 is closed by a lower rear plate 18, the lower edge of which is affixed to the rear edge of bottom plate 17. The upper edge of the lower rear plate 18 is formed with a V-shaped depression 181, one side of which is affixed to a beveled portion 141 of the rear wall 14 by rivets 19. Holes H1 are formed through the lower rear plate 18 including holes H1 in the other side **181*b* of the V-shaped depression 181** to provide for the circulation of air therethrough.

In the construction of the refrigerated display cabinet, the outer plate 142 of the rear wall 14, and the lower rear plate 18 are in the same vertical plane L1, as shown in FIG. 4, which is displaced from the vertical plane L2 defined by the rear edge of the side walls 16 to define a gap G between the planes L1 and L2. Since the rear of the cabinet 11 thus consists of a flat surface defined by the wall 14 and plate 18, it is sufficiently attractive to permit freestanding use of the cabinet as well as use against a wall. Furthermore, when the display cabinet is placed with the rear edge of the end walls 1C against a wall, an exhaust air duct is not required since the warm air from the blower 213 is exhausted through the holes H1 into the space 23 defined by the gap G between the outer plate 142 of the rear wall 14 and the wall against which the cabinet is set.

By directing the warm air exhausted by the blower 213 upwardly through the space 23 onto the surface of the transparent panels 30, this exhaust air may be used to prevent condensation on the transparent panels 30. To direct the exhaust air onto the transparent panels 30, the upper wall 15 is provided with an air duct 40 between the upper plate 151 and the insulating element 152 within the upper wall 15. The air duct 40 has an outlet end 401 opening along the upper portion of the guide rail mechanism 31a onto the transparent panels 30 and an inlet end 402 communicating with the space 23 through inlet holes H2 formed through an upper plate 153 that may be integral with the upper wall 15 and forms a smooth continuation of the outer plate 142 of the rear wall 14. As shown in FIG. 4, the rear portion of the insulating element 152 is formed with a gradually increasing thickness toward the front opening 401 and conversely, the depth of the air duct 40 is gradually decreased toward the front opening 401. A blower 41 is supported on a plate 43 at the inlet end 402 adjacent the holes H2 and functions to draw air from the space 23 through the holes H2 and forces it into the air duct 40 toward the outlet end 401 and thus to circulate it onto the outer surface of the transparent panels 30 and thereby prevent condensation on the surface of the transparent panels 30.

A number of blowers 41 are used over the width of the cabinet as required, there being two blowers 41 and the cooperating air ducts 40 and holes 42 in the illustrated cabinet.

Figure 5:
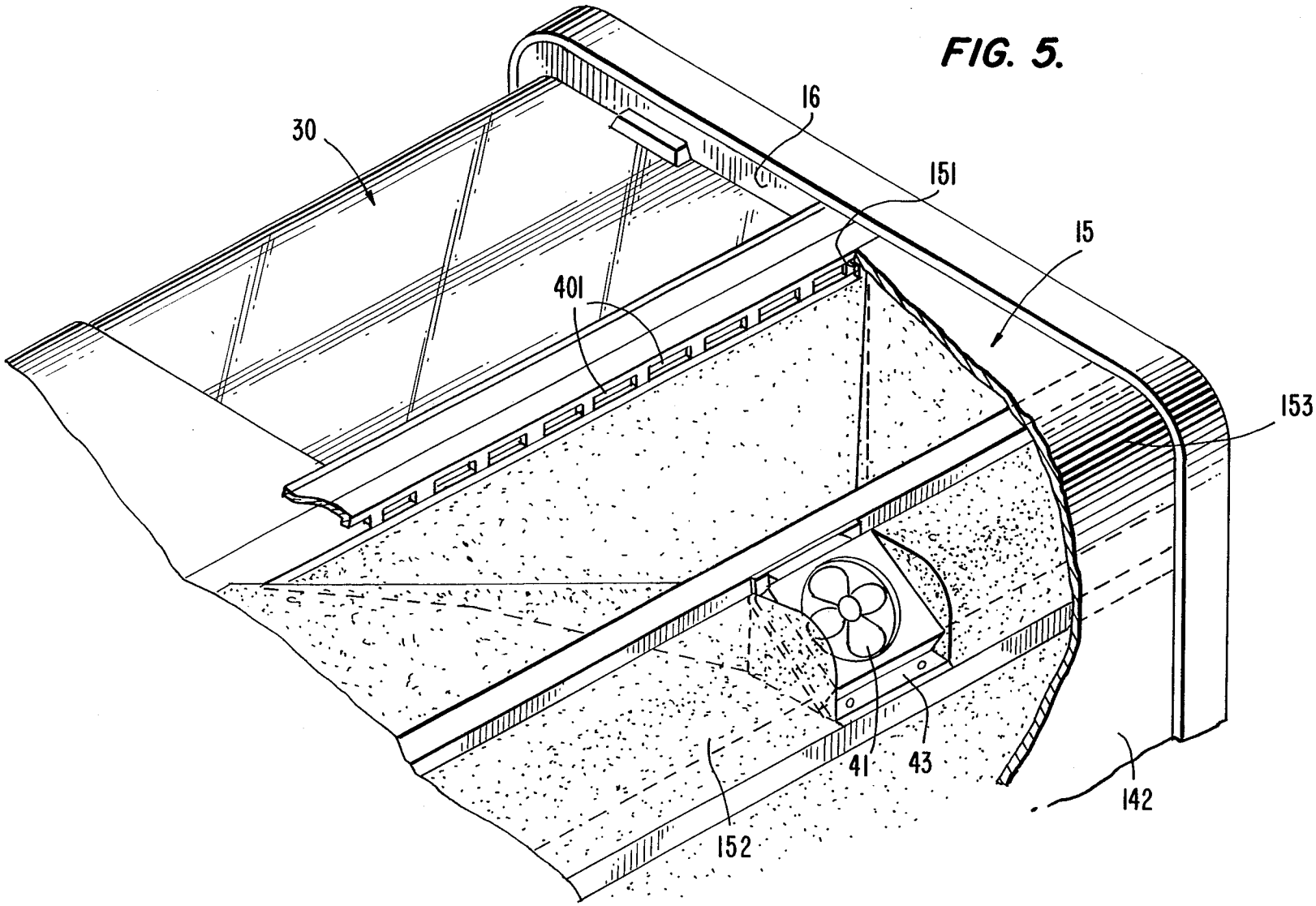
FIG. 5 is a fragmentary perspective view of the refrigerated display cabinet in accordance with another embodiment of present invention.

To distribute the air uniformly over the surface of the transparent panels 30, the air ducts 40 may not only decrease in depth toward the outlet opening 401, but, as shown in FIG. 5, may also be formed partly in the upper wall 15 and diverge from the inlet opening 402 toward the outlet opening 401. With two blowers 41 and cooperating ducts 40 and air inlet holes H2, each of the ducts 40 at their outlet openings 401 cover half of the length of cabinet. In this manner, air drawn into the air duct 40 through holes H2 is uniformly distributed on the surface of the transparent panels 30 through the outlet end 401 of the air duct 40.

Figure 6:
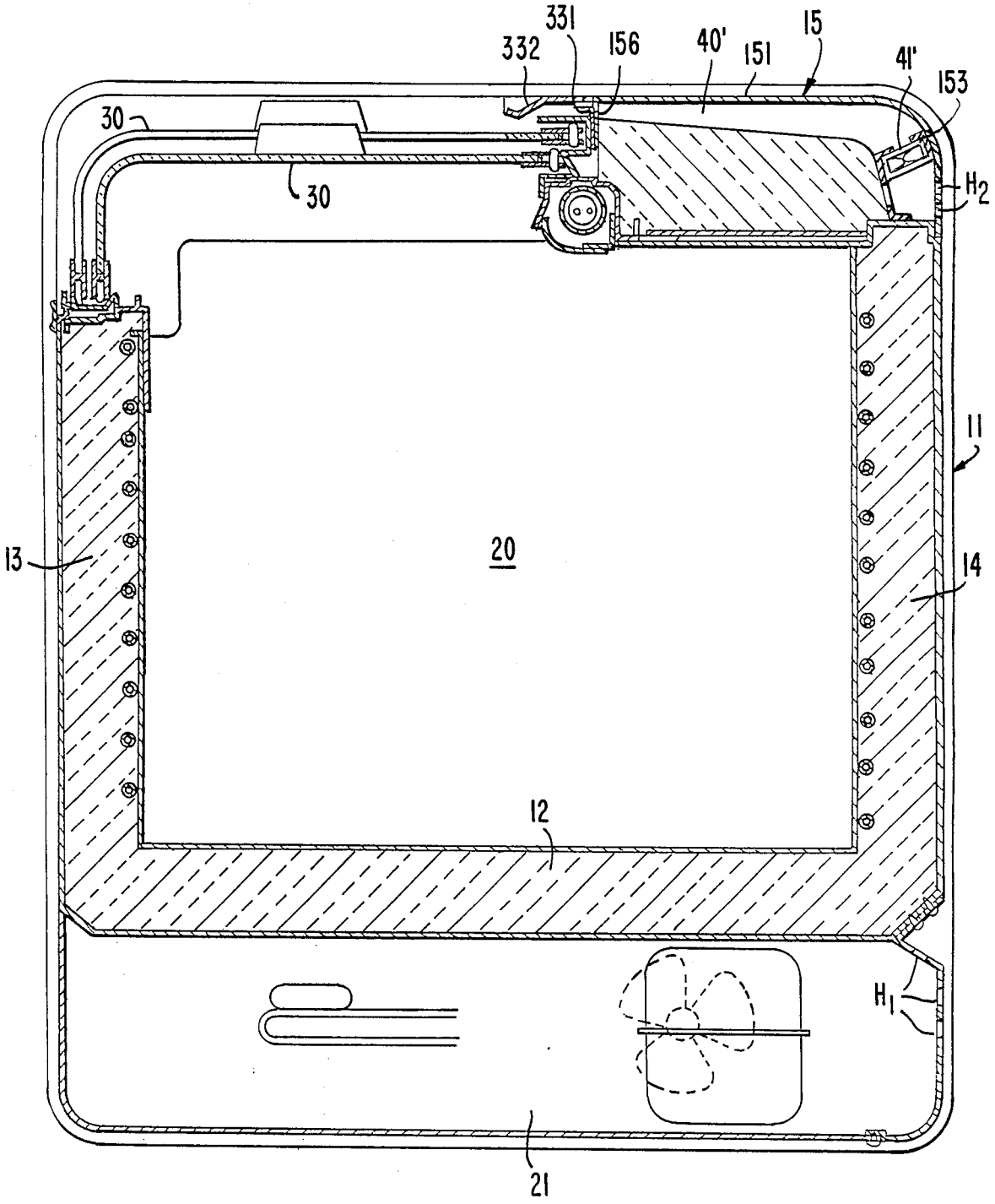
FIG. 6 is a vertical sectional view of a refrigerated display cabinet in which a modified air duct structure is shown.

With the blower slanted relative to the air path in the duct 40, as shown in FIG. 4, there is resistance to the flow of air through the duct 40 and thus a reduction in the amount of the air delivered by the blower 41. To decrease the resistance to the flow of air, there is shown in FIG. 6, an air duct 40' formed along the inner surface of the upper rear plate 153 and the upper plate 151, and a blower device 41' disposed transversely within the air duct 40'.

Figure 7:
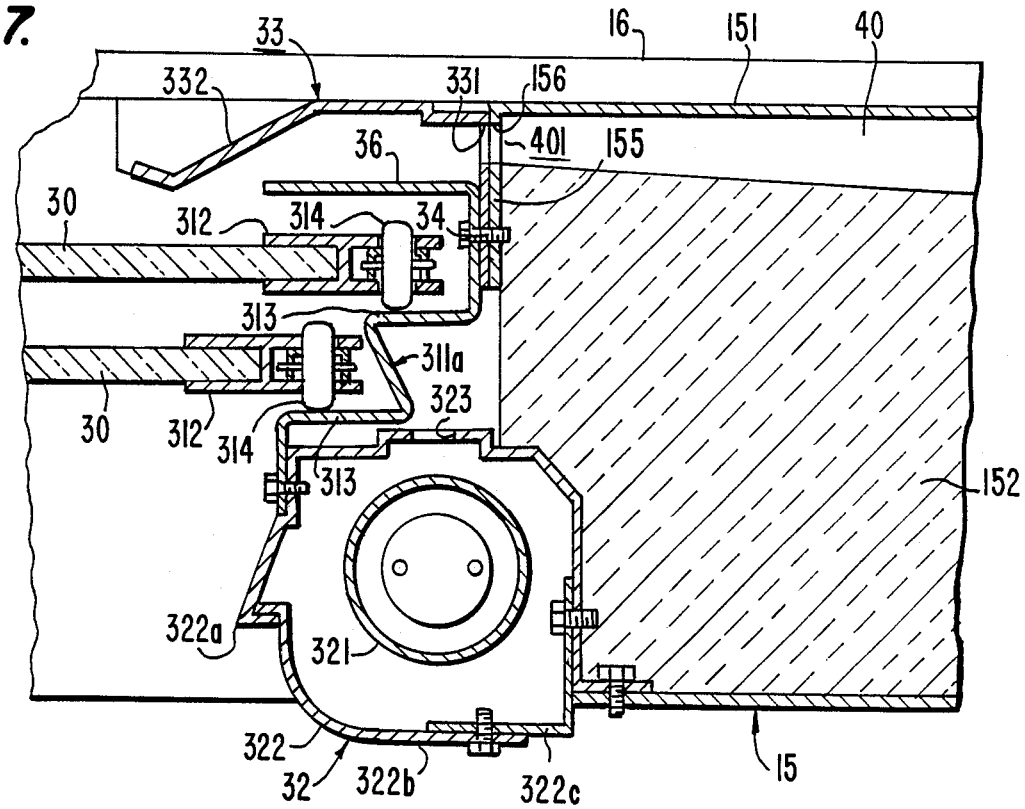
FIG. 7 is a enlarged sectional view of the area enclosed in circle A in FIG. 4.
Figure 8:
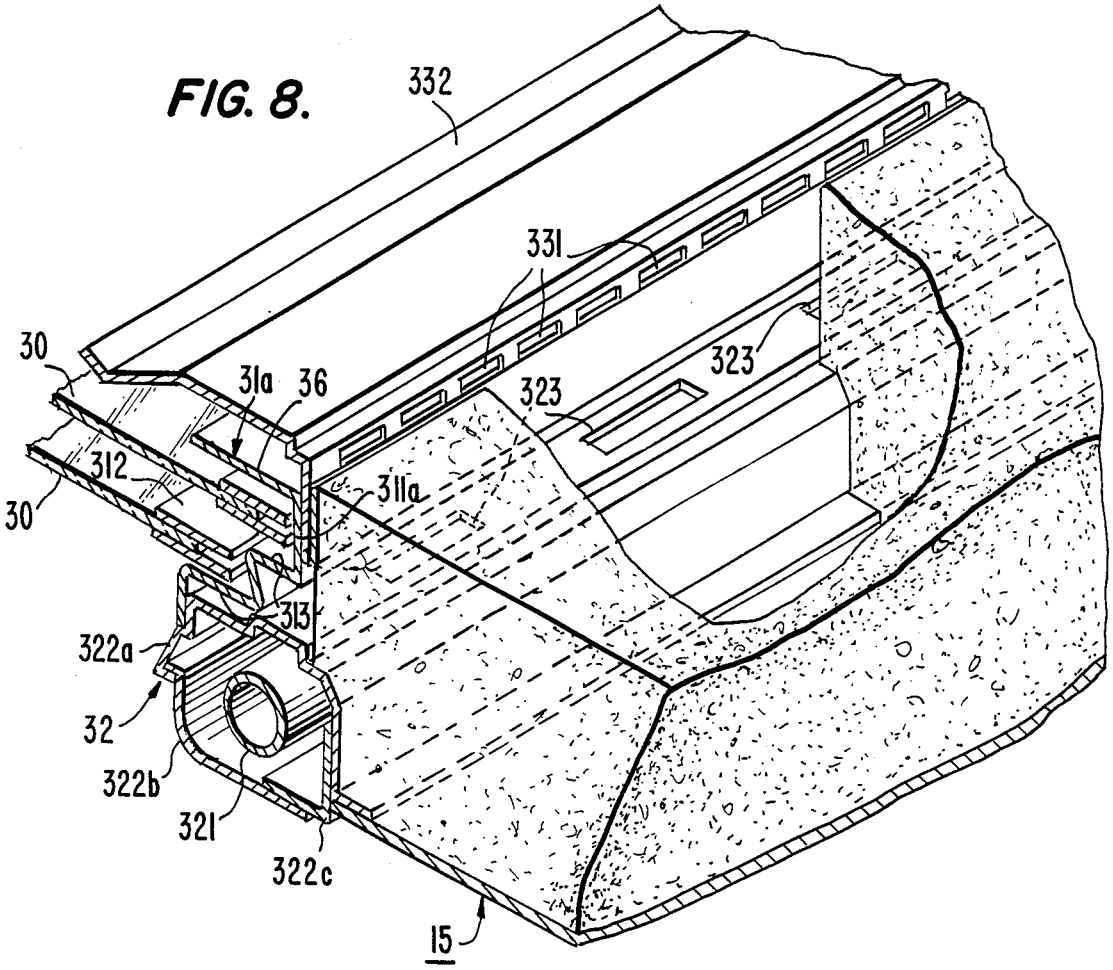
FIG. 8 is a fragmentary perspective view on an enlarged scale of the apparatus shown in FIG. 6.

Referring to FIGS. 4 and 7, the guide rail mechanisms **31*a* and 31*b* for the transparent panels 30 comprise rail elements 311*a* and 311*b* respectively fixed to walls 15 and 13 and frames 312 attached to the edge of each of the transparent panels 30. The rail element 311*a* is fixed on the front end portion 155 of the upper plate 151 of upper wall 15 through support frame 33 by screws 34 and provided with a horizontal flat running surface 313 for each of the transparent panels 30. The rail element 311*b* is fixed on the top of the front wall 13 and provided with a dual railway 315. The frames 312 rotatably support wheels 314 which run on the running surfaces 313 of the rail element 311*a* and the railway 315 of the rail element 311*b* whereby the transparent panels 30** are adapted to be moved relative to each other longitudinally of the cabinet.

A plurality of holes 156, 331 are formed through the front end portion 155 of the upper plate 151 and the support frame 33 for passage of the air, and the upper end portion of the support frame 33 has a flange portion 332 extending horizontally to cover the edge of the transparent panels 30 and directing the warm air flowing from the outlet opening 401 toward the outer surface of transparent panels 30. However, since the guide rail mechanism **311*a* has no sealing, some of the warm air flowing from the outlet opening 401 tends to enter into the refrigerating chamber 20 through the guide rail mechanism 311*a*. To avoid this, the guide rail element 311*a* has an air guide element 36 extending horizontally from the upper end thereof over the frames 312 and the wheels 314 carried thereby to form with the flange portion 332 of the support frame 33** a passageway for the air.

Illuminating means 32 is affixed on the front end of the upper wall 15 below the guide rail element **311*a* and comprises a series of flurorescent lamps 321 and three-part cover frames 322 consisting of an upper cover plate 322*a*, a lower cover plate 322*b* and a connecting element 322*c*. Upper cover plate 322*a* is attached on the front end of the upper wall 15 and provided with a plurality of holes 323 (as shown in FIG. 7). These holes 323 are adjacent the flat running surface 313 of the rail element 311*a*, whereby the rail element 311*a* is heated by the lamp 321** to prevent condensation without influencing the merchandise stored in the cabinet.

This invention has been described in detail in connection with the preferred embodiments, but these embodiments are merely for example only and this invention is not restricted thereto, It will be easily understood by those skilled in the art that other variations or modifications can be easily made within the scope of this invention, as defined by the appended claims.

I claim:

1. In a refrigerated display cabinet including a refrigerating chamber to store and display merchandise and a mechanical chamber in which the refrigerating apparatus is located, an access opening into said refrigerating chamber, movable transparent panels for closing said access opening, said mechanical chamber having an opening, a rear plate for closing said opening and having a plurality of holes for the circulation of air from the interior thereof to the atmosphere, blower means for circulating air from said mechanical chamber through said holes, said refrigerating chamber having a front wall and a rear wall, a bottom wall connected between the lower portions of said front and rear walls, an upper wall partly covering said access opening and having a rear plate, and a pair of side walls having rear edges, the improvement comprising said rear plates of said mechanical chamber and of said upper wall being aligned in the same plane with said rear wall, which plane is displaced forwardly from a plane defined by the rear edges of said side walls whereby when the cabinet is positioned against the wall, the rear wall thereof is spaced from such wall, said upper wall having a duct to direct air onto the surface of said transparent panels, said rear plate of said upper wall having a plurality of holes communicating with said duct for the circulation of air from the atmosphere into said duct, said upper wall having an air outlet opening for directing air from said duct onto said transparent panels, and blower means in said duct for circulating air through said duct onto said transparent panels.

2. The refrigerated display cabinet as claimed in claim 1 wherein said upper wall has a flanged portion extending horizontally therefrom over said air outlet opening for directing air from said outlet opening onto said transparent panels.

3. In a refrigerated display cabinet including a refrigerating chamber to store and display merchandise and a mechanical chamber in which the refrigerating apparatus is located, an access opening into said refrigerating chamber adapted to be covered by movable transparent panels, said mechanical chamber having an opening to provide for the circulation of air from the interior thereof to the atmosphere, and a rear plate for covering said opening and provided with a plurality of holes, said refrigerating chamber having a front wall and rear wall, a bottom wall connected between the lower portions of said front and rear walls, an upper wall partly covering said access opening and having a rear plate, and a pair of side walls having rear edges, the improvement comprising said rear plate being aligned in the same plane with said rear wall, which plane is displaced forwardly from a plane defined by the rear edges of said side walls whereby when the cabinet is positioned against a wall, the rear wall thereof is spaced from such wall, said upper wall having a duct to direct air from the rear of said cabinet to the surface of said transparent panels, a guide rail mechanism attached at a front edge of said upper wall to movably support said transparent panels and including a rail element having horizontal running surfaces for supporting said transparent panels, and a frame element for mounting a fluorescent lamp carried by said upper wall and disposed below said guide rail mechanism, said frame element having a plurality of holes for transmitting radiant heat of said fluorescent lamp to said guide rail mechanism.

* * * * *